United States Patent [19]

Davis et al.

[11] Patent Number: 4,799,935

[45] Date of Patent: Jan. 24, 1989

[54] METHOD FOR DYEING IN HIGH-BOILING NONIONIC SOLVENTS

[75] Inventors: James K. Davis, Greensboro; Robert S. Craycroft, Sophia; Tina V. Lorenzo, Jamestown, all of N.C.

[73] Assignee: Burlington Industries, Inc., Greensboro, N.C.

[21] Appl. No.: 40,825

[22] Filed: Apr. 21, 1987

[51] Int. Cl.[4] ..... C09B 67/10

[52] U.S. Cl. ..... 8/922; 8/924; 8/938

[58] Field of Search ..... 8/938, 922, 924

[56] References Cited

U.S. PATENT DOCUMENTS

| | | | |
|---|---|---|---|
| 3,467,484 | 9/1969 | Hermes | 8/15 |
| 3,518,734 | 7/1970 | Hermes | 28/247 |
| 3,771,949 | 11/1973 | Hermes | 8/4 |
| 4,047,889 | 9/1977 | Hermes | 8/93 |
| 4,055,971 | 11/1977 | Hermes | 68/9 |
| 4,115,054 | 9/1978 | Hermes | 8/17 |
| 4,500,321 | 2/1985 | Hugelshofer | 8/527 |
| 4,529,405 | 7/1985 | Wilson | 8/583 |

*Primary Examiner*—John F. Niebling
*Assistant Examiner*—Isabelle Rodriguez
*Attorney, Agent, or Firm*—Nixon & Vanderhye

[57] ABSTRACT

Textiles, especially polyester, nylon and high-tenacity nylon, are continuously dyed in an organic medium containing a high-boiling, nonionic solvent admixed with one or more lower-boiling organic solvents and at least one dyestuff dissolved in the solvent media. The lower-boiling solvent acts as a carrier to entrain the dye and allows the dye to enter the fiber evenly. The non-aqueous dyestuff medium allows the process to be conducted above the boiling point of water which facilitates dye penetration into the fiber and, in turn, shortens the dyeing process. Atmospheric pressure may be used, thus avoiding the constraints of a batch-type operation of pressurized dyeing procedures, as is conventionally used in this art. Fabric may be dyed in open width under restraint at elevated temperatures thereby achieving uniform coloring of the fabric without shade variations from end-to-end or "tailing". Dyeing the fabric at elevated temperatures with dimensional control allows the fabric to be heatset simultaneously with the dyeing.

24 Claims, No Drawings

METHOD FOR DYEING IN HIGH-BOILING NONIONIC SOLVENTS

The present invention relates to an improved process for dyeing textiles and, in particular, to a process for rapidly dyeing fibers, fabrics, and garments made from thermoplastic materials, such as polyester, nylon, and high-tenacity nylon at high temperatures.

BACKGROUND OF THE INVENTION

The dyeing of textiles, especially garments and fabrics of a synthetic material such as polyester, usually is carried out with a dyestuff dispersed in an aqueous bath. The textile material is placed in the bath for a long enough time period to allow sufficient dyestuff to be absorbed to provide the desired coloration.

Such a dyeing process poses several disadvantages and limitations. Since the temperature of the aqueous bath cannot exceed the boiling temperature of the water, the process cannot be conducted at elevated temperatures, unless high pressure is used. Even then temperatures of only 250° F. to 270° F. are reached. Consequently, relatively long dyeing cycles are needed.

Dyeing at elevated temperatures with a non-aqueous system overcomes many of these problems and provides several advantages. Elevated temperatures reduce the time needed to dye the textile material. Shorter dyeing cycles make the process more economical and efficient.

Various dye processes that use non-aqueous dye compositions have been proposed for the treatment of textile materials. One technique involves immersing the textile material in a bath with an organic dyestuff dissolved in a high-boiling, nonionic organic medium, such as a high-boiling aromatic ester or a cycloaliphatic diester. Such dyeing processes have several inherent disadvantages that prevent their effective and efficient use. The dye composition does not remain stable over a period of time when used in an ambient atmosphere. As reported in Clifford U.S. Pat. No. 4,550,579, significant degradation of the dye composition often occurs after only a few hours of use, especially at elevated temperatures.

In the entrainment dyeing process as described in copending, commonly-assigned U.S. application Ser. No. 067,799, filed June 30, 1987, the high-boiling dyeing medium behaves as a carrier fluid to allow the dyestuff to enter the fiber evenly. In that process, a significant amount, often as much as 50% to 120% by weight, of the dyeing medium is needed to smoothly apply the dyes due to the low solubility of most dyestuffs in the dyeing medium. The amount of high-boiling dyeing medium needed to perform the dye carrier fluid task is an amount much lower than the amounts mentioned above needed to apply the dyestuffs. It is desirable to reduce the amount of high-boiling media applied to the fabric due to a number of economic factors.

In addition, dyestuff solutions containing more than 5% by weight dyestuff are difficult to prepare. Mixing is also complicated by having to use powdered dyes. Cleanup of application equipment is slow because of the high viscosity of the medium dyestuff solution. The invention described in detail below provides solutions to all of these problems.

SUMMARY OF THE INVENTION

The process of the present invention allows a lower percentage by weight of high-boiling dyeing solution to be applied to the fabric but retains the same effective amount of dyestuff applied to the fabric. This is accomplished by applying a mixture of dyestuffs, high-boiling dyeing media, and a low-boiling solvent to the fabric. In this manner, the amount of high-boiling media applied is reduced while still allowing an adequate, effective amount of dyestuffs to be applied to the fabric. The low-boiling solvent(s) acts as an application aid and provides a means for evenly distributing the high-boiling dyeing medium. As the fabric and entrained mixture are heated, the low-boiling solvent evaporates off leaving a highly concentrated media/dyestuff solution evenly distributed on the fabric. The amount of high-boiling media remaining is sufficient to perform the carrier fluid function. The process also permits preparation of stock solutions of virgin dyestuff to be made and used to make and reconstitute the medium/dyestuff feed stream. It allows easier mixing and holding of the feed stream and facilitates cleanup due to lower viscosity feed streams. Another advantage of the process of this invention is the reduction of the possibility of solution degradation due to the ability to apply the dyestuff medium at room temperature.

It is therefore an object of the present invention to provide an improved process for dyeing of textiles at an elevated temperature in which the dyestuff does not undergo significant degradation.

It is an object of the present invention to provide a process for non-aqueous dyeing of textiles at elevated temperature that allows for the recycling of the dye composition without significant degradation of the dyestuff.

It is also an object to provide an apparatus for the non-aqueous dyeing of textiles at an elevated temperature that uses a minimum amount of dye composition, but provides excellent heat transfer properties.

Additional objects and advantages of the invention will be set forth in part in the description that follows, or may be learned by practice of the invention. The objects and advantages of the invention may be realized and obtained by means of instrumentalities and combinations particularly pointed out in the appended claims.

DETAILED DESCRIPTION OF THE INVENTION

The present invention includes, in admixture with a high-boiling, nonionic solvent or solvent system, one or more lower-boiling solvents as ingredients in the medium/dyestuff feed stream. The inclusion of significant quantities of lower-boiling solvent in the dyeing medium provides numerous benefits. By making the lower-boiling solvent, or system of solvents, a significant component, for example, 5–95% of the feed stream, the amount of the more costly high-boiling dyeing medium applied to the fabric is reduced. The amount of dyestuff added remains constant. The lower-boiling solvents readily evaporate off when the fabric enters the oven, leaving a highly concentrated medium/dyestuff solution evenly distributed on the fabric. The drying oven may be provided with a solvent recovery system to reclaim the evaporated solvents. Raw dyestuffs can be mixed directly with the lower-boiling solvents to form stock feed solutions and the solvents in the dye bath make uniform mixing and application of the dye liquor simpler. Cleanup of processing equipment and fabric scouring before and after dyeing is accomplished using a scouring solvent which is the same as one of the low-boiling solvents, with the cleanup washoff going to the solvent recovery system. The low-boiling solvent added need not be the same as the scouring solvent but it is advantageous for it to be.

This process offers several advantages. Total high-boiling dyeing medium utilization is reduced to a minimum with no reduction in the quality of the dyed fabric. The problems that are attendant to dye mixing and solubilization are significantly reduced if not eliminated. Cleanup is significantly faster and more efficient. The lower viscosity of the dyeing medium and higher dyestuff solubility will allow mixing, application and holding to be done at room temperature, thus reducing the possibility of media/dyestuff degradation. Since the low-boiling solvent is dyestuff compatible, more dyestuff families may be compatible with the high-boiling dyeing medium system. The low add-on of high-boiling dyeing medium eliminates the need for vacuum removal prior to scouring. Since medium/dyestuff concentrations and solvent recovery are higher, storage requirements are lessened. Distillation of the scouring solvents need not be quite as rigorous when the scouring solvent is the same as one of the low-boiling solvents since the presence of some solvent in a recycle stream is advantageous.

High-boiling, nonionic media suitable for carrying out the process of this invention are described in various U.S. and foreign patent documents more fully identified below. These and other patents are merely illustrative of suitable nonionic media; however the principles of this invention are applicable to any high-temperature liquid dyeing system. A wide variety of low-boiling solvents can be used for the process of this invention. Among those found suitable are acetone, N-methyl-2-pyrrolidone, N,N-dimethylformamide and dimethylsulfoxide.

Low-boiling solvents suitable for use in the process of the present invention must satisfy a number of requirements. First, the boiling point of the low-boiling solvent or solvent system selected must fall within the range of about 100° F. to about 400° F., and preferably less than 350° F. The low-boiling solvent selected should have the ability to solubilize or disperse a wide variety of dyes and, lastly, it should be compatible with the high-boiling, nonionic solvent used in the solvent medium.

| | Physical Property Data | |
|---|---|---|
| Solvent | Boiling Point | Flash Point |
| Acetone | 56.2° C. (133° F.) | −9.4° C. (15° F.) (open cup) |
| DMF (N,N—dimethylformamide) | 152.8° C. (307° F.) | 57.7° C. (136° F.) |
| DMSO (dimethylsulfoxide) | 189° C. (372° F.) | 95° C. (203° F.) (open cup) |
| N—methyl-2-pyrrolidone | 202° C. (396° F.) | 95.5° C. (204° F.) |
| tris(2-ethylhexyl)trimellitate | >315.5° C. (>600° F.) | 260° C. (500° F.) (open cup) |

As indicated, a high-boiling, nonionic organic medium is one component of the dye medium used in the process of this invention, and by this we mean a composition that remains stable within the temperature range of from about 50° F. to about 450° F. Such high-boiling, nonionic organic solvents are described in the patent literature and elsewhere as vehicles or solvents for dyestuffs and pigments to form waterless dyeing compositions. See, for example, U.S. Pat. No. 4,155,054 to Hermes describing the use of glycol or glycol ethers as high-boiling liquids for waterless dyeing and heat setting of textiles as well as the aromatic esters and cycloaliphatic diesters disclosed in U.S. Pat. No. 4,293,305 to Wilson.

The preferred aromatic esters can be of the formula $ArCOOR_2$, $ArCOO\text{-}R_1\text{-}OOCAr$ or $(ArCOO)_2\text{-}R_3$, wherein $R_1$ is alkylene of 2–8 carbon atoms or polyoxyalkylene of the formula $—C_rH_{2r})_s$, in which r is 2 or 3 and s is up to 15; $R_2$ is substituted or unsubstituted alkyl or alkenyl of 8-30 atoms; $R_3$ is the residue of a polyhydric alcohol having z hydroxyl groups; Ar is mono- or bicyclic aryl of up to 15 carbon atoms and z is 3–6.

Furthermore, the cycloaliphatic ester can be of the formula:

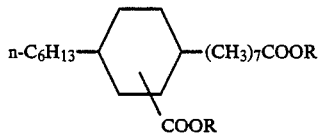

wherein R is substituted or unsubstituted straight or branched chain alkyl of 4–20 carbon atoms, polyoxyalkylene of the formula $R'\ (OC_xH_{2x})_n$ or phosphated polyoxyalkylene of the formula:

$$(HO)_2P(=O)(OC_xH_{2xn}OC_xOC_xH_{2x})$$

or a salt thereof, wherein $(OC_xH_{2x}O)_n$ is $(C_2H_4O)_n$—,$(C_3H_6O)_n$—or $(C_2H_4O)_p$, or $(C_3H_6O)_q$—; $R^1$ is H or ArCO; Ar is mono- or bicyclic aryl of up to 15 carbon atoms; x is 2 or 3; n is 2–22 and the sum of p+q is n.

The preferred high-boiling, nonionic organic solvents include triesters of 1,2,4-benzenetricarboxylic acid, also known as trimellitic acid. Preferred esters are tris(2-ethylhexyl)trimellitate, trisisodecyl trimellitate, trisisoocytyl trimellitate, tridecyl trimellitate, and trihexadecyl trimellitate. It will be understood that mixed esters such as hexyl, ocytyl, decyl trimellitate can also be used. Most preferred is tris(2-ethylhexyl)trimellitate (CAS No. 3319-31-1), also known as trioctyl trimellitate, which can be purchased from Eastman Chemical Products, Inc., Kingsport, Tennessee, as Kodaflex® TOTM.

Other solvents suitable for this invention include, among others, those described in U.S. Pat. Nos. 4,293,305; 4,394,126; 4,426,297; 4,581,035; 4,602,916; 4,608,056; and 4,609,375.

The preparation of the materials described above is given in U.S. Pat. No. 4,529,405, the disclosure of which is herein incorporated by reference.

The ratio of admixture of high-boiling to low-boiling solvents should fall within the range of about 95:5 to 5:95. The exact blend or ratio will depend upon a number of factors, easily empirically determined by the skilled operator. These factors include the nature of the equipment in which the process is conducted, the identity of the fiber or fiber blend in the textile material being dyed, the nature of the dyestuff or final color of the fabric to be dyed, and the heat history of the fabric to be heat set. The operational temperatures at which the process is to be conducted, the extent to which the various solvents are recovered and reused, as well as the environmental concerns with respect to the particular solvent or solvent system employed in formulating the dyeing medium are all taken into account.

Patent documents and other literature pertaining to non-aqueous dyeing at elevated temperatures using high-boiling, nonionic solvents as the dye medium refer only generally to the type of dyestuff presented to the fibers to be dyed in the high-boiling organic solvent medium. As a practical matter, conventional wisdom indicates that only a limited class of dyes are suited. This is because of the nature of the high-boiling, organic or non-ionic solvent itself—virtually all dyestuffs are insoluble or, at best, only sparingly soluble in this material. For this reason, disperse dyes are the dyes of choice in these non-aqueous, high-temperature dyeing operations. Because of this constraint, the choice of dyes has been necessarily limited, and the textile colorist may not be able to achieve the particular shade desired or the dyed textile may not possess the requisite properties, such as lightfastness, anti-crocking, washfastness, and the like. Thus, the term high-boiling "solvent" is perhaps a misnomer insofar as solubility of a dyestuff in this liquid is concerned. In contrast to these high-boiling, nonionic materials, a high percentage of virtually all dyestuffs are soluble in the low-boiling solvents used in accordance with the process of the present invention. This favorable solubility allows the textile colorist a much wider range of dyes from which to select.

The process of the invention may be conducted in a non-reactive environment. This environment is provided by a composition that can be maintained as a stable gas at the operational, dyeing temperature, without reacting with the dye composition or the textile material, and that will displace the air and, therefore, the oxygen surrounding the textiles. Suitable materials include halogenated hydrocarbons or fluorocarbons, inert gases such as nitrogen, argon, neon, and helium, carbon dioxide and combinations of such gases. Nitrogen is most preferred.

The invention is further described in the following non-limiting examples in which, as in the claims, all parts and percentages are by weight unless otherwise indicated.

EXAMPLE 1

Dual Solvent Swatch Dyeings

Three 500 gram solutions were made each containing 10 grams of Disperse Blue 56. The remaining 490 grams of each of the solutions consisted of the following: Solution 1, a 50/50 mixture of acetone and tris(2-ethylhexyl) trimellitate, a high-boiling solvent Solution 2, a 75/25 mixture of acetone and tris(2-ethylhexyl) trimellitate; and Solution 3, which was used as a control, 100% tris(2-ethylhexyl)trimellitate.

Solutions 1 and 2 were mixed at room temperature. Two swatches of Cordura, approximately 3 grams each, and two swatches of Suraline, approximately 2 grams each (both products of DuPont), were immersed into each solution and padded. Percent wet pick-up for the Suraline samples ranged from 100 to 130% and for the Cordura samples ranged from 46 to 55%. The acetone was allowed to evaporated from each of the fabric samples at room temperature.

Solution 3 was heated to 250° F. and two samples each of Cordura and Suraline were immersed into the bath and padded. Solution 3 was heated to increase dispersion of the dye and lower viscosity of the solution. The percent wet pick-ups for the Cordura and the Suraline samples were in the same ranges as given previously.

All fabric swatches were placed in a Despatch oven at 375° F., for two minutes. The samples were scoured in acetone. The samples dyed from the 75/25 acetone/-tris(2-ethylhexyl) trimellitate mixture were the most evenly dyed. The Cordura samples dyed from the 75/25 mixture appeared the same color as the Cordura samples dyed from the 100% high-boiling solvent.

EXAMPLE 2

Dual Solvent Swatch Dyeings

Five 500 gram solutions were made each containing 10 grams of Disperse Blue 56. The remaining 490 grams of each of the solutions consisted of the following: Solution 1, a 90/10 mixture of acetone and tris(2-ethylhexyl) trimellitate; Solution 2, a 75/25 mixture of acetone and tris (2-ethylhexyl)trimellitate; Solution 3, a 50/50 mixture of acetone and tris(2-ethylhexyl) trimellitate; Solution 4, 100% tris(2-ethylhexyl) trimellitate; and Solution 5, 100% acetone. Solutions 4 and 5 were used as controls.

Out of each pad bath one sample of Cordura (41 to 43 grams) and one sample of Suraline (28 to 32 grams) was padded. All samples were padded at room temperature except samples padded from Solution 4. Solution 4 was heated to 250° F. before samples were immersed and padded. The percent wet pick-up for Cordura in Solutions 1 through 4 ranged from 33 to 37%. The percent wet pick-up for Suraline in Solutions 1 through 4 ranged from 102 to 60%. The wet pick-up data taken from the samples padded in Solution 5 was not accurate due to acetone's high evaporation rate.

The acetone was allowed to evaporate from each of the samples at room temperature. Each sample was pinned onto a frame and passed through a Benz oven at 390° F., (30 seconds at temperature) for 45 seconds. The samples were scoured in acetone. Sample 2 of Cordura dyed out of the 75/25 mixture of acetone and tris(2-ethylhexyl) trimellitate was the most uniformly dyed Cordura sample.

EXAMPLE 3

Dual Solvent Swatch Dyeings

The following dye baths, each weighing 245 grams were made: Solution 1 was 100% DMF (dimethyl formamide); Solution 2 was a 80/20 mixture of DMF and tris(2-ethylhexyl) trimellitate; Solution 3 was a 60/40 mixture of DMF and tris(2-ethylhexyl)trimellitate; Solution 4 was a 40/60 mixture of DMF and tris(2-ethylhexyl)trimellitate; Solution 5 was a 20/80 mixture of DMF and tris(2-ethylhexyl) trimellitate; and Solution 6 was 100% tris(2-ethylhexyl)trimellitate. To each solution was added 5 grams of Disperse Blue 56.

A sample of Suraline (approximately 4 grams) and a sample of Cordura (approximately 6 grams) was immersed and padded from each solution. All pad baths were kept at room temperature except solution 6 which was heated to 90° C. Solution 6 (100% tris(2-ethylhexyl)trimellitate) was heated to increase dye dispersion and lower viscosity.

After padding all samples were placed in a despatch oven at 100° F. for three minutes. While being heated at 100° F. the DMF evaporated. The samples were removed and then placed in another despatch oven at 350° F., for two minutes to dye the samples. The fabric swatches were scoured in acetone.

All samples had a high color yield. The samples dyed from the 100% tris(2-ethylhexyl)trimellitate solution had the lowest color yield.

EXAMPLE 4

Dual Solvent Swatch Dyeings

Six dye baths, each containing 245 grams of solvents and 5 grams of Disperse Blue 56, were made. The percentages of solvents in each bath were as follows: Solution 1 - 100% N-methyl-2-pyrrolidone; Solution 2 - 80/20 mixture of N-methyl-2-pyrrolidone and tris(2-ethylhexyl) trimellitate; Solution 3 - 60/40 mixture of N-methyl-2-pyrrolidone and tris(2-ethylhexyl) trimellitate; Solution 4 - 40/60 mixture of N-methyl pyrollidone and tris(2-ethylhexyl)trimellitate; Solution 5 - 20/80 mixture of N-methyl-2-pyrrolidone and tris(2-ethylhexyl)trimellitate; and Solution 6 -100% tris(2-ethylhexyl)-trimellitate.

A swatch of Cordura (approximately 3 grams) and a swatch of Suraline (approximately 2.5 grams) were immersed in each dye bath and padded. The dye baths were kept at room temperature except for Solution 6. Solution 6 was heated to 250° F. before the samples were padded. After padding, the samples were placed in a despatch oven at 390° F. for two minutes. All fabric swatches were scoured in acetone. The color yield of the samples decreased as the amount of tris(2-ethylhexyl)trimellitate in the dye bath increased.

EXAMPLE 5

Solvent Swatch Dyeings

To improve the solubility of crude dyestuff in the dual solvent dye bath, a third solvent was added to the dye bath. Four dye baths were made, each containing one of the following percentages of crude Disperse Blue 56: 1%, 3%, 5%, and 7%. The remainder of the 250 gram baths contained equal portions of DMSO, acetone and tris(2-ethylhexyl)trimellitate.

A small swatch of Cordura and Suraline was immersed into each dye bath, and then padded. The dye baths were not heated. After the acetone had evaporated from each sample at room temperature, the samples were placed in a Despatch oven at 360° F., for two minutes. All samples were scoured in acetone.

The samples showed greater shade development than samples dyed with tris(2-ethylhexyl)trimellitate alone. Total dye penetration was revealed in photomicrographs of the dyed fibers.

What is claimed:

1. A continuous process for dyeing textiles made of synthetic thermoplastic fibers at elevated temperatures in a non-aqueous organic medium comprising:

(a) contacting the textile made of synthetic thermoplastic fibers to be dyed with a non-aqueous dyeing medium composed of (1) a high-boiling, nonionic solvent admixed with (2) at least one lower-boiling solvent having a boiling point in the range of about 100° F. to about 400° F., the lower boiling solvent constituting at least 40% by weight of the non-aqueous dyeing medium, and (3) a tinctorial amount of at least one soluble dyestuff dissolved in the solvent media; and (b) heating the fabric after step (a) to a temperature above the boiling point of the lower-boiling solvent, causing the lower-boiling solvent to evaporate leaving a highly-concentrated dyeing medium evenly distributed on the textile, and causing the non-aqueous dyeing the textile to a uniform shade.

2. The process of claim 1 in which the textile is a fabric and is dyed in open width under restraint and the fabric is simultaneously heatset and dyed.

3. The process of claim 1 in which the high-boiling, nonionic solvent is present in an amount of from 5 to 95% by weight and the low-boiling solvent is present in an amount of 95 to 5% by weight of the non-aqueous dyeing medium.

4. The process of claim 3 in which the dyestuff is present up to about 10% by weight of the non-aqueous dyeing medium.

5. The process of claim 3 in which at least 70% of the non-aqueous dyeing medium is the low-boiling solvent.

6. The process of claim 5 in which the high-boiling solvent and the low-boiling solvent are present in about equal amounts by weight.

7. The process of claim 1 in which the low-boiling solvent is selected from:

acetone;
N-methyl-2-pyrrolidone;
N,N-dimethylformamide; and
a mixture of acetone and dimethylsulfoxide.

8. The process of claim 1 in which the low-boiling organic solvent has a boiling point of less than 350° F.

9. The process of claim 1 in which the dyestuff is substantially completely dissolved in the low-boiling solvent and substantially insoluble in the high-boiling, nonionic solvent.

10. A continuous process for dyeing textiles made of synthetic thermoplastic at elevated temperatures in a non-aqueous organic dyeing medium comprising the steps of:

(1) contacting the textile made of synthetic thermoplastic fibers to be dyed with a non-aqueous organic dyeing medium composed of:
from 5 to 95% by weight of a low-boiling solvent having a boiling point in the range of from 100° F. to about 400° F.,
a tinctorial amount up to about 10% by weight of at least one dyestuff that is soluble in the low-boiling solvent,
balance a high-boiling nonionic solvent;

(2) heating the fabric of step (1) in an enclosed chamber at a temperature of at least 250° F. and for a period of time sufficient for the low-boiling solvent to fully penetrate and dye the fibers of the textile;

(3) recovering the low-boiling solvent evaporated in the enclosed chamber; and (4) rinsing the dyed textile in an organic liquid to remove any organic solvent and any unfixed dye remaining on the textile.

11. The process of claim 10 in which the low-boiling solvent recovered in step (3) is used in rinse step (4).

12. The process of claim 10 in which the fabric is heated in step (2) at a temperature in the range of about 250° F. to about 400° F.

13. The process of claim 10 in which the textile is a fabric and is dyed in open width under restraint and the fabric is simultaneously heatset and dyed.

14. The process of claim 10 in which the high-boiling, nonionic solvent is present in an amount of from 5 to 95% by weight and the low-boiling solvent is present in an amount of from 95 to 5% by weight of the non-aqueous dyeing medium.

15. The process of claim 14 in which the dyestuff is present up to about 10% by weight of the non-aqueous dyeing medium.

16. The process of claim 14 in which at least 70% of the non-aqueous dyeing medium is the low-boiling solvent.

17. The process of claim 16 in which the high-boiling solvent and the low-boiling solvent are present in about equal amounts by weight.

18. The process of claim 10 in which the low-boiling solvent is selected from:

acetone;

N-methyl-2-pyrrolidone;

N,N-dimethylformamide; and a mixture of acetone and dimethylsulfoxide.

19. The process of claim 10 in which the low-boiling organic solvent has a boiling point of less than 350° F.

20. The process of claim 10 in which the dyestuff is substantially completely dissolved in the low-boiling solvent and substantially insoluble in the high-boiling, nonionic solvent.

21. A continuous process for dyeing textiles made of synthetic thermoplastic fibers at elevated temperatures in a non-aqueous organic dyeing medium comprising the steps of:

(1) contacting the textile made of synthetic thermoplastic fibers to be dyed with a non-aqueous organic dyeing medium composed of:

from 5 to 95% by weight of a low-boiling solvent having a boiling point in the range of from 100° F. to about 350° F. and selected from acetone, N-methyl-2-pyrrolidone, N,N-dimethylformamide, and a mixture of acetone and dimethylsulfoxide, a tinctorial amount up to about 10% by weight of at least one dyestuff that is soluble in the low-boiling solvent, balance a high-boiling solvent;

(2) heating the fabric of step (1) in an enclosed chamber at a temperature of at least 250° F. and above the boiling point of the low-boiling point solvent for a period of time sufficient to evaporate the low-boiling solvent leaving a highly concentrated dyeing medium evenly distributed on the textile to fully penetrate and dye the synthetic thermoplastic fibers of the textile;

(3) recovering the low-boiling solvent evaporated in the enclosed chamber; and (4) rinsing the dyed textile in an organic liquid to remove any organic solvent and any unfixed dye remaining on the textile.

22. The process of claim 1, in which the synthetic thermoplastic fibers are polyester, nylon or high-tenacity nylon.

23. The process of claim 10, in which the synthetic thermoplastic fibers are polyester, nylon or high-tenacity nylon.

24. The process of claim 21, in which the synthetic thermoplastic fibers are polyester, nylon or high-tenacity nylon.

* * * * *

UNITED STATES PATENT AND TRADEMARK OFFICE

CERTIFICATE OF CORRECTION

PATENT NO. : 4,799,935

DATED : January 24, 1989

INVENTOR(S) : James K. Davis, Robert S. Craycroft and Tina V. Lorenzo

It is certified that error appears in the above-identified patent and that said Letters Patent is hereby corrected as shown below:

In column 4, line 7, the expression "$-C_rH_{2r})_s$," should read -- $-C_rH_{2r})(OC_rH_{2r})_s$,--.

In column 4, line 29, a dash should be inserted between the subscript "p" and the comma in the center of the line.

In column 4, line 38, the word "ocytyl" should read --octyl--.

In column 5, line 45, a semicolon should be inserted between the word "solvent" and the word "Solution".

In column 5, line 56, the word "evaporated" should read --evaporate--.

In column 6, line 27, "60%" should read --160%--.

In column 6, line 60, a comma should be inserted after the word "padding".

In column 6, line 60, the word "despatch" should read --Despatch--.

In column 6, line 63, the word "despatch" should read --Despatch--.

In column 7, line 23, the word "despatch" should read --Despatch--.

In column 7, line 68, the phrase --medium to enter the fibers of the textile evenly thereby dyeing-- should be inserted between the words "dyeing" and "the".

Signed and Sealed this

Twentieth Day of March, 1990

*Attest:*

JEFFREY M. SAMUELS

*Attesting Officer*

*Acting Commissioner of Patents and Trademarks*